US011737569B2

(12) United States Patent
Haham et al.

(10) Patent No.: US 11,737,569 B2
(45) Date of Patent: Aug. 29, 2023

(54) CUSHIONING FOR FURNITURE ITEM

(71) Applicant: KETER HOME AND GARDEN PRODUCTS LTD, Herzliya (IL)

(72) Inventors: Yaacov Haham, Ashkelon (IL); Gali Kudin Amar, Rehovot (IL); Hannah Spaander, Tel Aviv (IL)

(73) Assignee: KETER HOME AND GARDEN PRODUCTS LTD, Herzliya (IL)

( * ) Notice: Subject to any disclaimer, the term of this patent is extended or adjusted under 35 U.S.C. 154(b) by 0 days.

(21) Appl. No.: 17/633,422

(22) PCT Filed: Aug. 4, 2020

(86) PCT No.: PCT/IL2020/050851
§ 371 (c)(1),
(2) Date: Feb. 7, 2022

(87) PCT Pub. No.: WO2021/028903
PCT Pub. Date: Feb. 18, 2021

(65) Prior Publication Data

US 2022/0279930 A1 Sep. 8, 2022

(30) Foreign Application Priority Data

Aug. 12, 2019 (IL) ..... 268638

(51) Int. Cl.
*A47C 7/02* (2006.01)
*A47C 9/00* (2006.01)
*A47C 7/26* (2006.01)

(52) U.S. Cl.
CPC ..... *A47C 9/002* (2013.01); *A47C 7/027* (2013.01); *A47C 7/26* (2013.01)

(58) Field of Classification Search
CPC ..... A47C 7/021; A47C 1/16; A47C 27/146; A47C 7/62; A61G 5/124
See application file for complete search history.

(56) References Cited

U.S. PATENT DOCUMENTS

| | | | | |
|---|---|---|---|---|
| 9,125,493 | B2 * | 9/2015 | Siekman | A47C 7/029 |
| 9,635,897 | B2 * | 5/2017 | Prust | A43B 13/38 |
| 2008/0030062 | A1 * | 2/2008 | Prust | A47C 7/021 297/452.45 |
| 2009/0042014 | A1 | 2/2009 | Synnestvedt et al. | |
| 2011/0095581 | A1 | 4/2011 | Pierce | |
| 2014/0182049 | A1 | 7/2014 | Prust et al. | |
| 2018/0103763 | A1 * | 4/2018 | Chernin | A47C 7/029 |

FOREIGN PATENT DOCUMENTS

| | | | | |
|---|---|---|---|---|
| DE | 29922174 | U1 * | 2/2000 | A47C 7/021 |
| FR | 379374 | A | 11/1907 | |

* cited by examiner

*Primary Examiner* — Sarah B McPartlin
(74) *Attorney, Agent, or Firm* — Vorys, Sater, Seymour and Pease LLP; Anthony P. Venturino; Maryellen Feehery Hank

(57) ABSTRACT

The presently claimed subject matter is directed to furniture elements. Further, the presently claimed subject matter concerns a furniture covering element configured with a cushioning arrangement.

19 Claims, 7 Drawing Sheets

CUSHIONING FOR FURNITURE ITEM

TECHNOLOGICAL FIELD

The present disclosure is directed to furniture elements. More particularly the disclosure concerns a furniture covering element configured with a cushioning arrangement.

BACKGROUND ART

References considered to be relevant as background to the presently disclosed subject matter are listed below:

US Patent Application 2009/0042014

Acknowledgement of the above references herein is not to be inferred as meaning that these are in any way relevant to the patentability of the presently disclosed subject matter.

BACKGROUND

US Patent Application 20090042014 discloses a compressible molded component comprises a compressible cushion member integrally formed with an additional member. The compressible cushion member is comprised of a deformable material formed by an injection molding process. During the molding process, the deformable material is injected in molten form into a core component of a mold, the core component having an array of protrusions. The array of protrusions in the mold forms an array of voids in the compressible cushion member when the component is removed from the mold. The additional member may include a skin member and/or a structural member attached to the compressible cushion member.

GENERAL DESCRIPTION

The present disclosure is directed to a cushioning pad for use in conjunction with a furniture element.

According to a first aspect of the disclosure, there is provided a furniture cushioning pad that is made of molded elastomer material and comprising a furniture engaging portion and at least a cushioning portion having top face and a bottom face, with a plurality of resilient prongs projecting from the bottom face; the prongs being configurable between a rest, non-deformed position, a pre-stressed position upon articulating the cushioning pad over a rigid surface portion of a furniture element, and a stressed position upon applying pressure over the top face thereof.

According to a second aspect of the disclosure, there is provided a furniture item comprising at least a rigid surface portion and a pad mounting portion, wherein a furniture cushioning pad is applied over said rigid surface portion with a furniture engaging portion secured to the pad mounting portion, and wherein said cushioning pad is made of molded elastomer material and comprises at least a cushioning portion having top face and a bottom face, with a plurality of resilient prongs projecting from the bottom face; said prongs configurable between a rest, non-deformed position, a pre-stressed position upon articulating the cushioning pad over a rigid surface portion of a furniture element, and a stressed position upon applying pressure over the top face thereof.

The arrangement is such that at a detached position, when the cushioning pad is free, i.e. removed from the furniture, the plurality of prongs are at rest and are substantially non-deformed. However, when the cushioning pad is applied over a rigid surface portion of a furniture item, and even more so upon securing the furniture engaging portion to the pad mounting portion, the prongs deform into a so-called pre-stressed position, and upon applying pressure over the top face of the cushioning pad, the prongs deform into the stressed position. Then, upon ceasing the pressure from the top face, the prongs spontaneously assume their pre-stressed position.

Stiffness/elasticity parameters of the prongs and of the cushioning portion define the softness of the cushioning pad when engaged by an individual.

Upon applying pressure over the top face of the cushioning pad, e.g. upon an individual sitting on the cushioning portion of the cushioning pad of the furniture item (i.e. resulting in applying pressure thereto), the bottom face temporarily nears towards the a rigid surface portion of a furniture item, resulting in further elastic deflection of the prongs, arbitrary deforming between the bottom face and the rigid surface, such that a soft, cushioning effect is sensed by the individual.

The disclosure also concerns a furniture system comprising at least one furniture item or a portion thereof, and at least one furniture cushioning pad according to the disclosure herein.

The term 'rigid' as used herein, with reference to the surface of the furniture item supporting the cushioning portion of the cushioning pad, denotes a substantially non-deformable surface. However, according to some examples, the rigid surface portion may be pliable, as sometimes is the case with comfort furniture.

Any one or more of the following features designs and configurations can be applied to any of the aspects of the present disclosure, separately or in various combinations thereof:

- The prongs can extend substantially parallel to one another;
- The prongs can have similar length;
- A longitudinal axis of the prongs can extend substantially normal to the bottom face;
- The prongs can be equally dispersed over the portion of the bottom face;
- The prongs can be of uniform cross-section;
- The prongs can have a tapering section along a longitudinal axis thereof;
- The prongs can have a staggered section along a longitudinal axis thereof;
- The prongs can be configured for deforming at different orientations for imparting different cushioning effects to the cushioning portion;
- The prongs can be pre-deformed at different orientations for imparting different cushioning effects to the cushioning portion;
- The prongs can be configured with different resiliency properties for imparting the cushioning portion with different cushioning effects;
- Elasticity of the prongs projecting from the bottom face of the cushioning pad can be equal over the entire cushioning portion thereof, or have different elasticity properties, so as to render the cushioning pad with differential cushioning properties;
- A thickness of a root of the prongs can be equal to or lesser than the thickness of the cushioning portion of the cushioning pad; according to other examples, the thickness of the root of the prongs can be greater than the thickness of the cushioning portion, however as long as the top face of the cushioning portion does not show deformation at the stressed position of the prongs;
- The thickness of the cushioning portion of the cushioning pad can be uniform;

The cushioning portion of the cushioning pad can be flat or slightly domed, to thereby obtain gradually changing stiffness;

The cushioning portion of the cushioning pad can be configured with reinforcements for governing stiffness/elasticity parameters thereof;

The cushioning pad can be configured with openings, so as to facilitate air discharge upon applying pressure over the top face thereof; the openings can be configured at the cushioning portion or at other locations thereof;

The rigid surface portion of the furniture item can be configured with openings, so as to facilitate air discharge upon applying pressure over the top face thereof;

Articulation of the furniture engaging portion to the pad mounting portion can require tensioning of at least a portion of the cushioning pad;

The furniture engaging portion of the cushioning pad can be configured for elastically tensioning over the pad mounting portion;

The furniture engaging portion of the cushioning pad can be a skirt portion configured for snug mounting over the pad mounting portion of a furniture item;

The furniture engaging portion of the cushioning pad can be configured for circumferential engaging over the pad mounting portion of the furniture item;

The furniture engaging portion of the cushioning pad can conform to a rigid surface portion of the furniture item;

The cushioning portion of the cushioning pad can conform to any furniture item, e.g. a seat, a bed, etc.;

The cushioning portion of the cushioning pad can conform to any one or more body engaging surfaces of a furniture item, or with portions of body engaging surfaces of a furniture item, e.g. a seat portion, a back rest, arm rest, foot rest, leg rest, head support, etc.;

At least the top face of the cushioning pad can be configured with a natural material mimicking pattern;

At least the top face of the cushioning pad can be configured with an embedded layer of other material, e.g. fabric, fibers, foil, etc.;

The cushioning pad can be detachably attached to the furniture item;

At the pre-stressed positions of the prongs, a root portion thereof can remain substantially non-deformed, with most deformation taking place at a distal portion (at the free end) of the prongs.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1B:
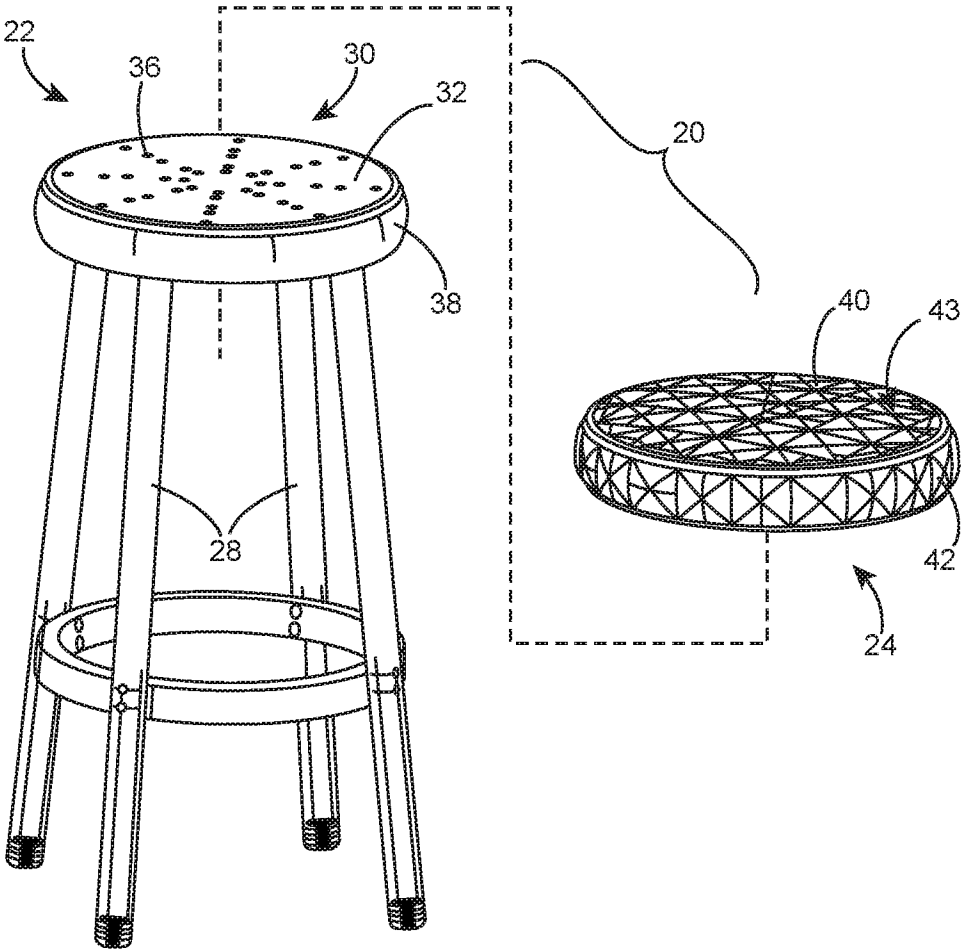
FIG. 1B is an exploded view of the furniture system of FIG. 1A.
Figure 1A:
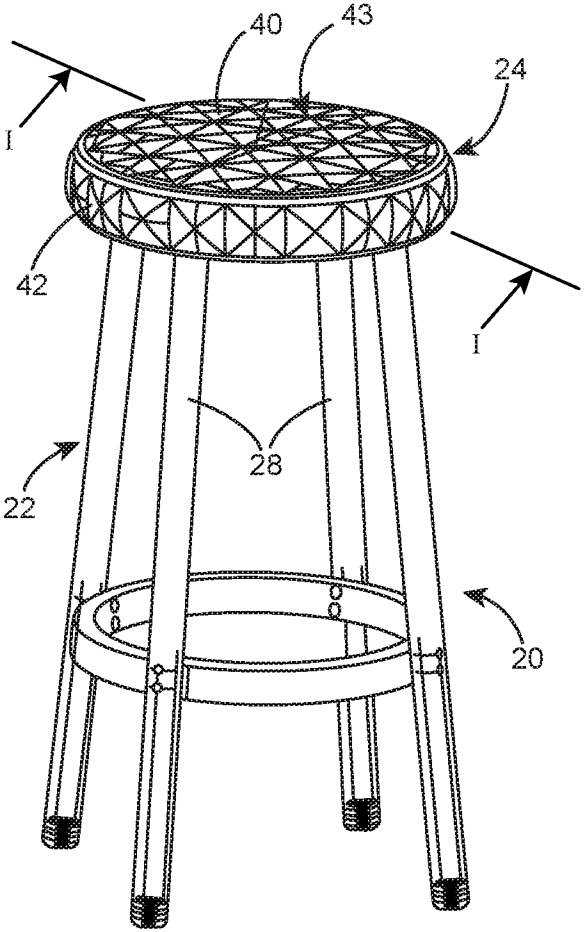
FIG. 1A is a top perspective view of a furniture system comprising a stool fitted with a cushioning pad, according to an example of the disclosure.
Figure 1D:
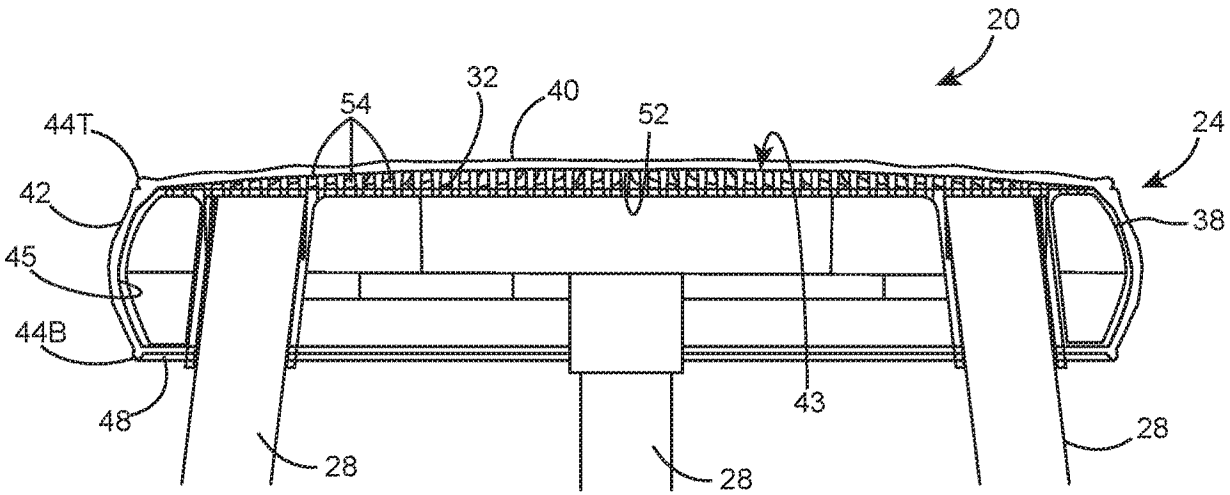
FIG. 1D is a planar view of FIG. 1C.
Figure 1C:
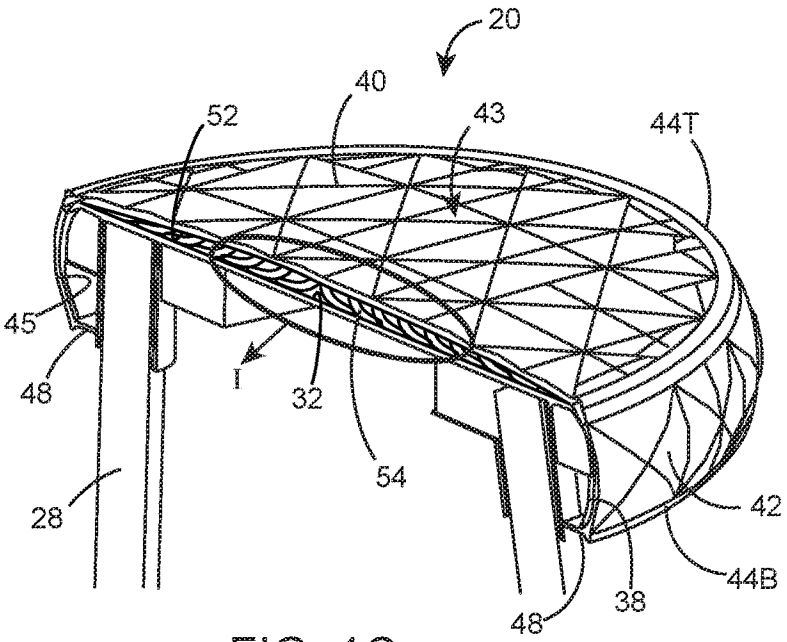
FIG. 1C is e section taken along line I-I in FIG. 1A, the prongs illustrated at their pre-stressed position.
Figure 1E:
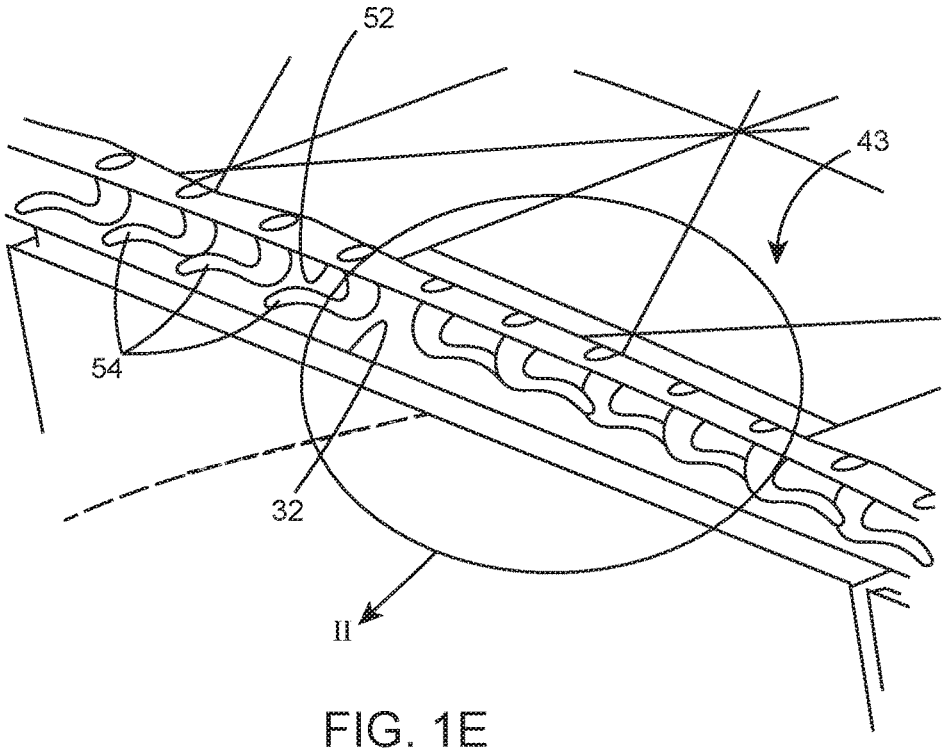
FIG. 1E is an enlargement of the portion marked I in FIG. 1C.
Figure 1F:
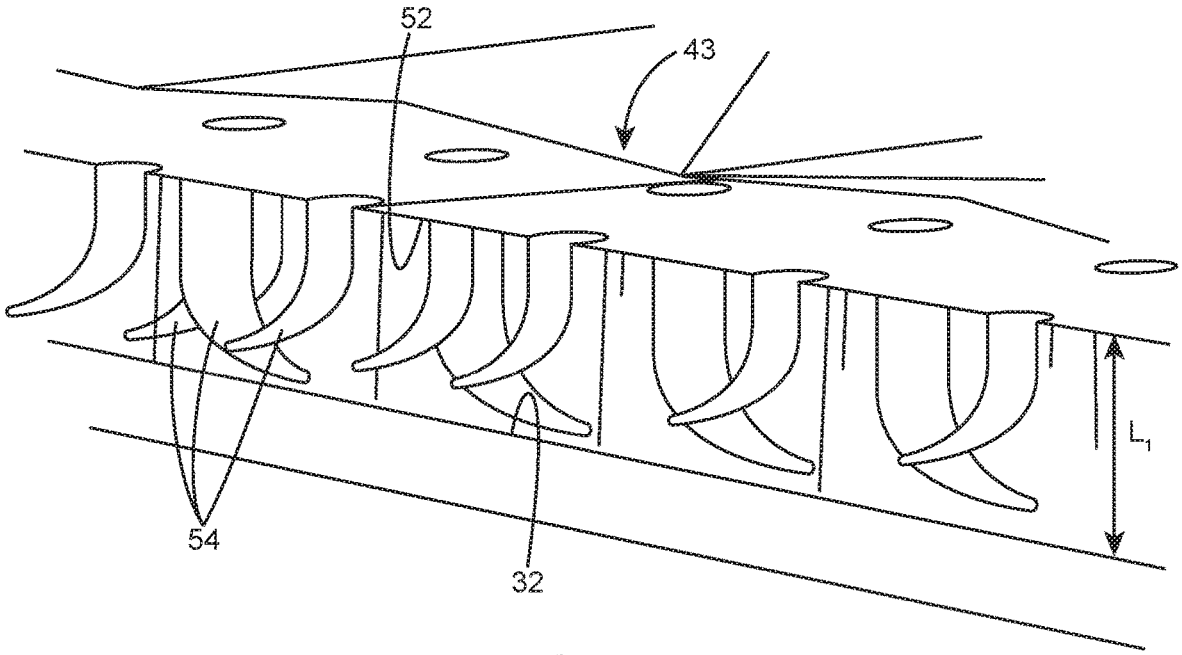
FIG. 1F is a supper-enlarged view of the portion marked II in FIG. 1E.

Attention is first directed to FIGS. 1A and 1B, illustrating a furniture item set generally designated 20, namely a stool 22 and a cushioning pad 24. The stool 22 is configured with four legs 28 and a seat portion 30 comprising a top flat, rigid seat surface portion 32 which in turn is configured with several openings 36, and an annular pad mounting portion 38, which in the illustrated example has a concaved section (best seen in the sectioned drawings, e.g. in FIG. 3D). Openings 36 serve as air discharge openings, to facilitate escape of air entrapped in the space between the stool's support surface 32 and the cushioning pad 24. Likewise, other openings can be configured, optionally also at the cushioning pad (not shown).

Figure 2A:
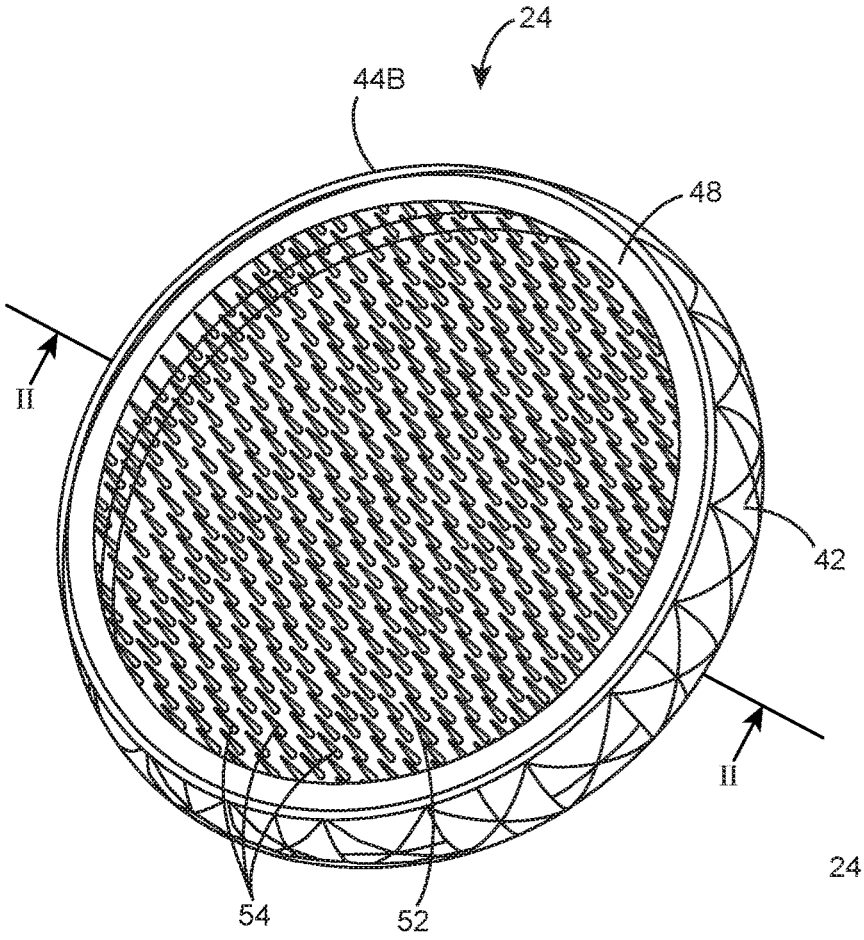
FIG. 2A is a perspective bottom view of the cushioning pad seen in FIG. 1B, the prongs at the rest, non-deformed position.
Figure 2B:
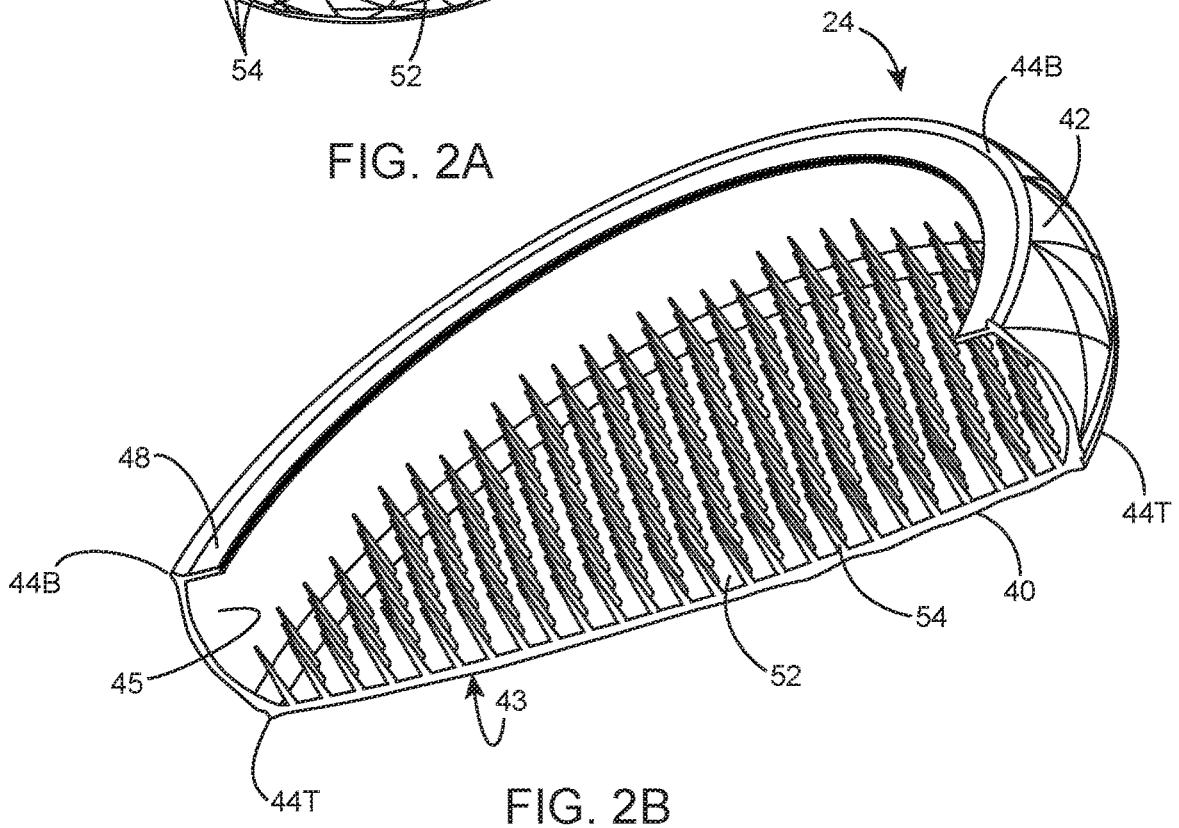
FIG. 2B is a section along line II-II in FIG. 2A.
Figure 2C:
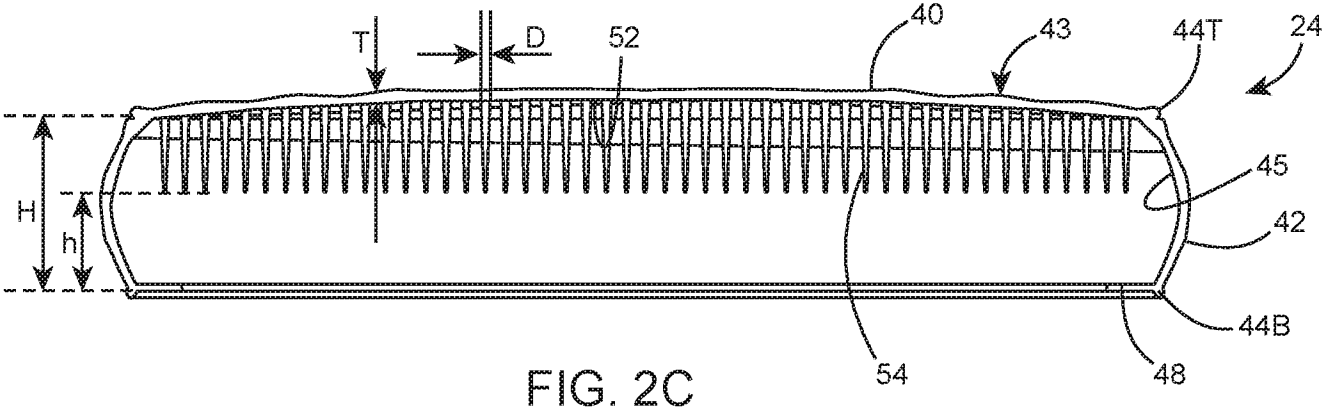
FIG. 2C is a planar sectioned view of the cushioning pad.

Turning now to the cushioning pad 24, and as can be seen better also in FIGS. 2A-2C, it is made of molded thermoplastic elastomeric material (e.g. SBS, SEBS, LDPE, etc.), generally bowl-like shaped with a generally flat cushioning portion 40 and an annular skirt 42 extending therefrom, having an inside surface 45. It is noted that the cushioning portion 40 is substantially flat, though according to the particular example it can be slightly domed.

An outside surface of the cushioning pad 24 (namely top face 43 and skirt 42) can mimic, as far as texture and color ('look and feel') a natural material, imparting it, in this specific example, with a quilted matelassé appearance. Even more so, the outside surface of the cushioning pad 24 of this specific example, is configured with annular stich-like patterns at a top edge 44T and a bottom edge 44B of the annular skirt 42, imparting it a realistic appearance. Also, at least the top face of the cushioning pad can be configured with an embedded layer of other material, e.g. fabric (not shown), imparting the cushioning pad a soft to touch and authentic appearance.

Radially inwardly extending from a bottom edge 44B of the skirt 42 there is an annular lip portion 48, which together with skirt 42 constitutes a furniture engaging portion, as will be discussed herein after in greater detail.

A bottom face 52 of the cushioning portion 40 is configured with a plurality of resilient spike-like prongs 54, which in the illustrated example are disposed in an ordered matrix, with their longitudinal axes projecting substantially normal from the bottom face 52 and parallelly disposed with respect to one another. By way of example, in the presently illustrated drawings, the prongs are conical, having a thinned free end, with a root of each prong having a thickness (diameter) D similar to or less than the thickness T of the cushioning portion 40 (at the location of the prongs 54), as illustrated in FIG. 2C. The prongs extend towards the bottom end of the cushioning pad 24, ending at a distance h from the bottom, and being shorter than the inside height H thereof. It is appreciated that since the cushioning portion 40 is slightly domed, the length of the prongs slightly differs, such that at the center of the cushioning portion 40 they are slightly longer as compared to the peripheral ones.

Whilst in the presently illustrated example the prongs are conical, it is appreciated that different prong configurations can be embodied. For example, prongs of different geometrical shapes and cross-sections can be disposed at the bottom face of the cushioning portion, having different resilience in different orientations and at varying levels of stiffness. Likewise, the prongs can be a priori oriented at specific direction, so as to impart prongs at certain zones with different elastic resistance.

Figure 3A:
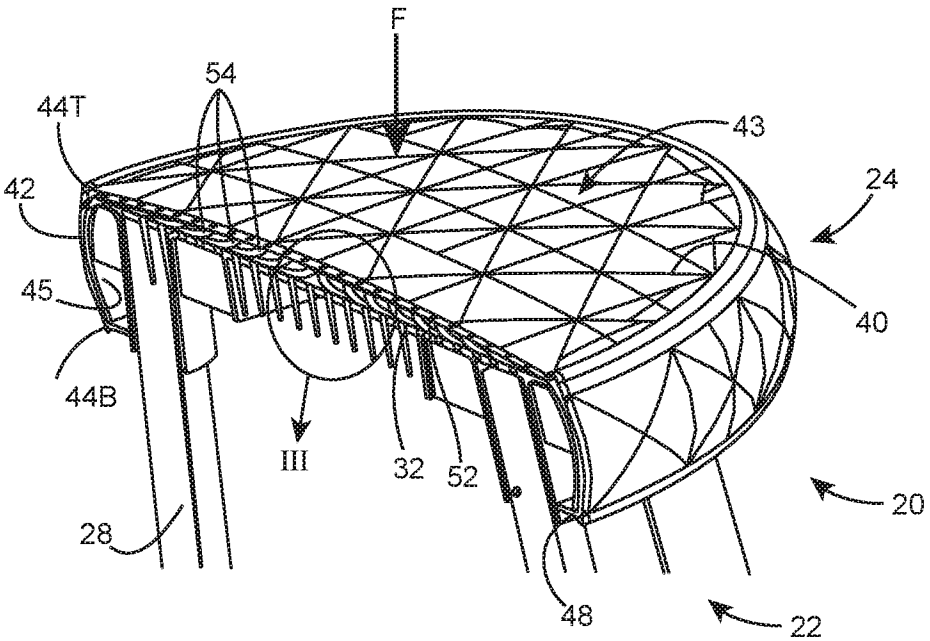
FIG. 3A is the same as FIG. 1C, however with pressure applied over the cushioning pad and the prongs are at the stressed position.
Figure 3B:
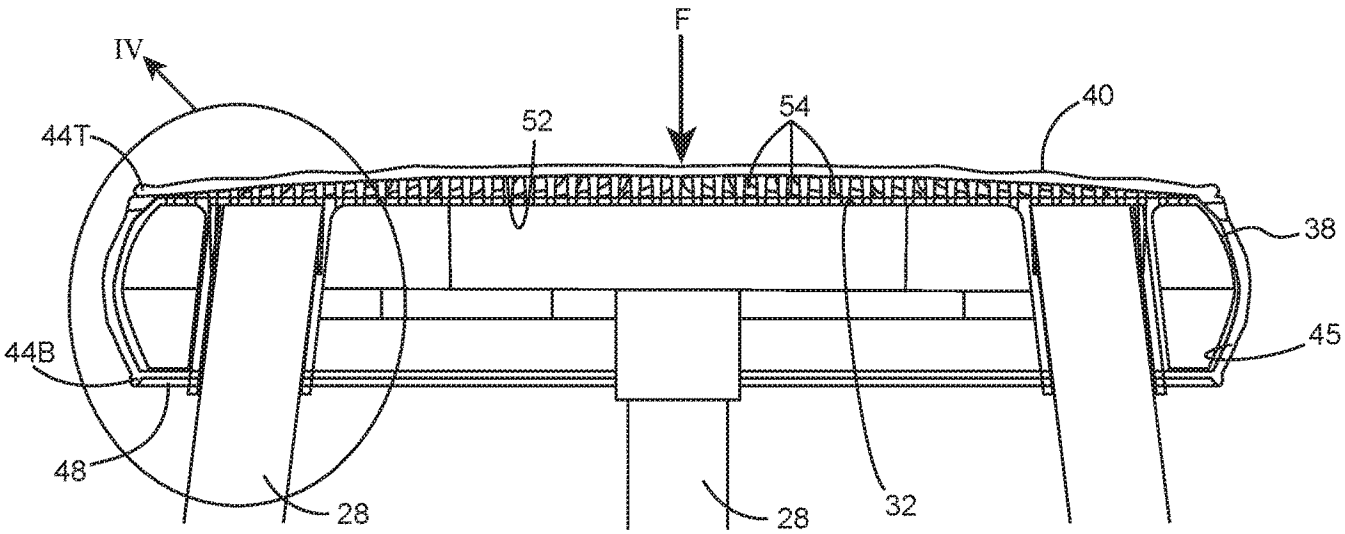
FIG. 3B is a planar view of FIG. 3A.
Figure 3C:
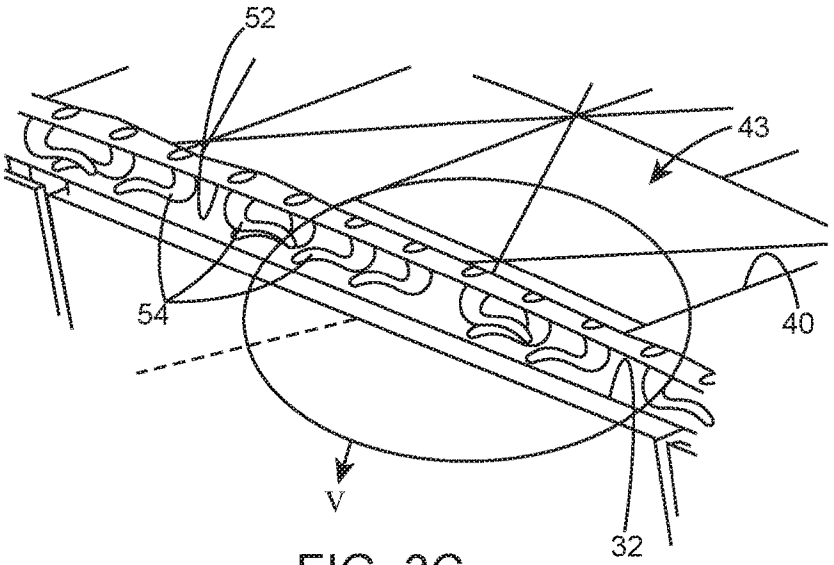
FIG. 3C is an enlargement of the portion marked III in FIG. 3A.
Figure 3D:
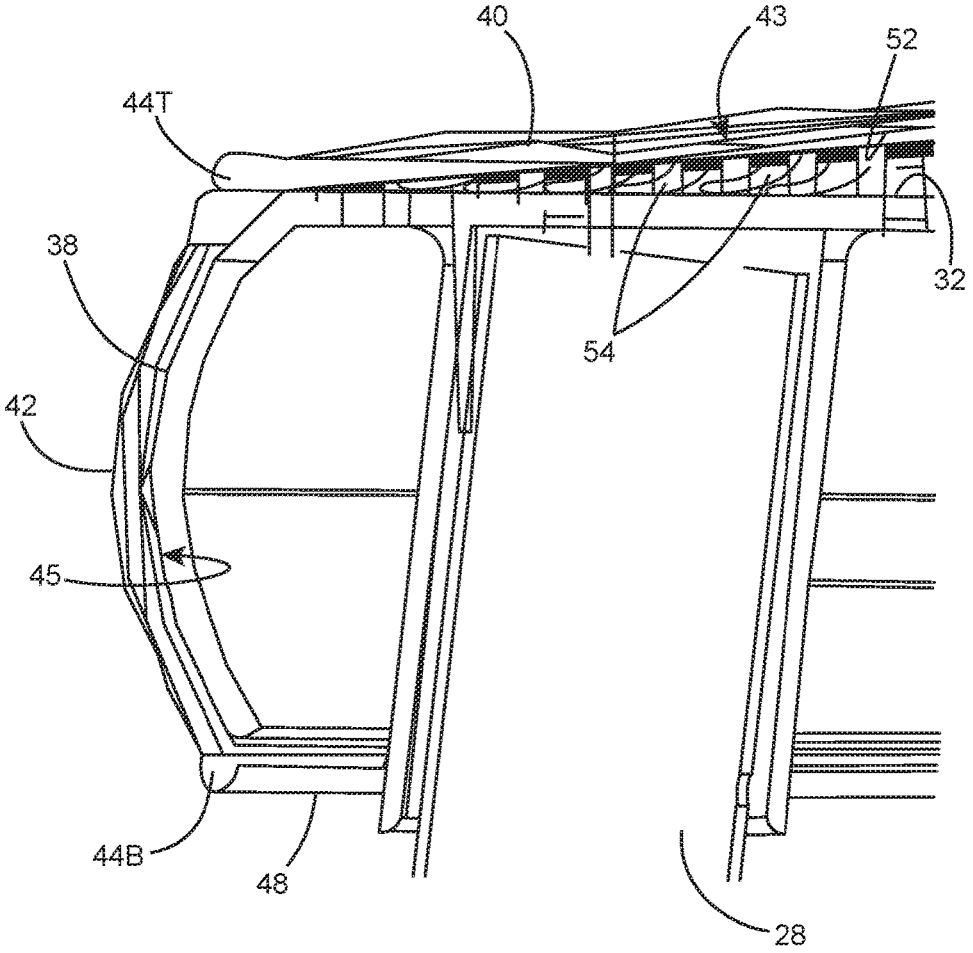
FIG. 3D is an enlargement of the portion marked IV in FIG. 3B.
Figure 3E:
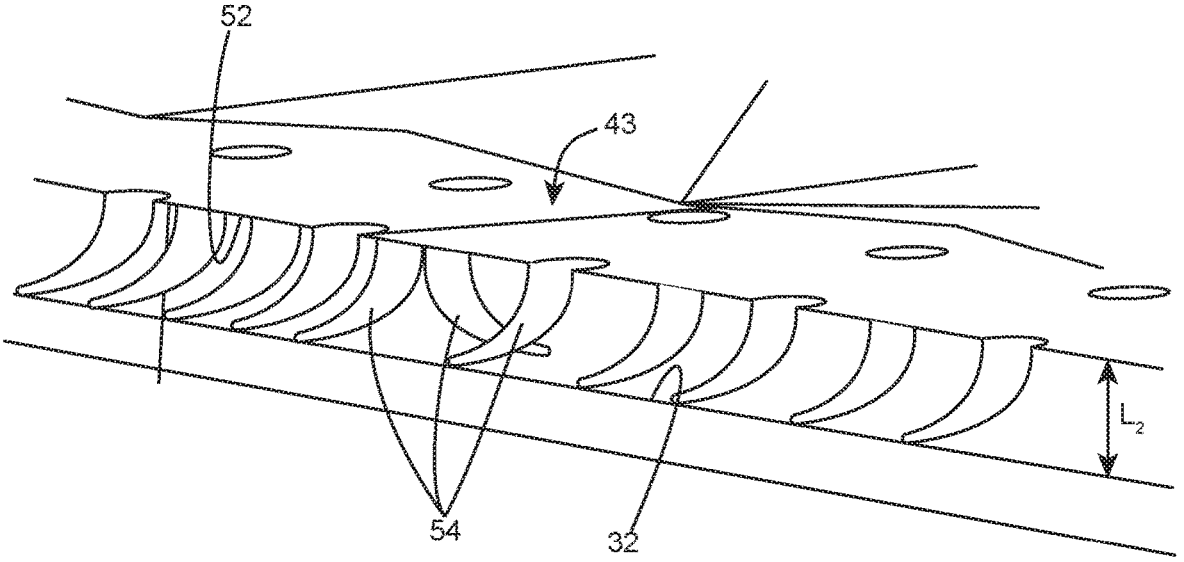
FIG. 3E is a supper-enlarged view of the portion marked V in FIG. 3C.

It is further noted that the annular skirt 42 has a curved section, conforming to the shape and size of the seat portion 30 of stool 22, the arrangement being such that the cushioning pad 24 is mountable over the seat portion 30 by stretching it over and allowing the annular lip portion 48 to engage below the seat portion 30, with the inside surface 45 of the annular skirt 42 bearing flush against the annular pad mounting portion 38 of the seat portion 30, whereby the cushioning pad 24 is tightly stretched and securely applied thereover, and will not spontaneously detach, as seen for example in FIG. 3D.

Whilst in the present example there is illustrated a particular pad mounting portion of the furniture item, with a corresponding particular furniture engaging portion, it should be appreciated that other engagement configurations are possible, however as long as at a mounted position the cushioning portion 40 of the cushioning pad 24 is well positioned and secured over the rigid surface portion 32 of the furniture item, and at least partially tensioned, so as to maintain the cushioning effect as will be discussed herein after.

It is appreciated that the prongs 54 of the cushioning pad 24 are flexibly deformable between three positions. The first position, the so-called 'rest position', is the natural position of the prongs, when the cushioning pad 24 is not applied over a bearing surface. This position is illustrated in FIGS. 1B and 2A to 2C, where the prongs 54 project substantially upright from the bottom face 52.

The second position, the so-called 'pre-stressed position', is the position the prongs acquire after positioning and attaching the cushioning pad 24 over the rigid seat surface portion 32 of the stool 22. At this position, illustrated in FIGS. 1C to 1F, the prongs are deflected from their natural projecting position, however mostly the free ends of the prongs deform, and the root portions of the prongs (those portions near the bottom face 52) remain mostly non-deformed. This occurs owing to the light pressure applied to the prongs 54 as a result of the articulation of the cushioning pad to the rigid surface of the stool. At the pre-stressed position, the free end portions of the prongs are randomly deformed, resulting in the cushioning portion 40 supported spaced from the top surface of the rigid seat surface portion 32, and imparting the cushioned pad a comfortable, cushioning appearance, with some resilience, such that depressing the top face 43 of the cushioning portion 40 against the rigid seat surface portion 32 will momentarily deform the cushioning portion 40 (into the third, stressed position, as will be discussed hereinafter), and upon ceasing the pressure it will reassume the pre-stressed position owing to elasticity of the prongs applying a biasing force and acting as 'springs' disposed between the rigid seat surface portion 32 of the stool and the bottom surface 52 of the cushioning portion 40 of the cushioning pad 24.

The third position, so-called 'stressed position', as illustrated in FIGS. 3A to 3E, force F is applied over the top face 43 of the cushioning portion 40, e.g. upon an individual sitting on the stool. The force F causes the already slightly deformed prongs 54 to further deform, also near their root portion, such that the bottom face 52 of the cushioning portion 40 nears to the rigid seat surface portion 32, i.e. distance $L_1$ (FIG. 1F) decreases to $L_2$ (FIG. 3E), against the biasing effect of the deformed prongs 54, imparting an occupant of the stool a cushioned feeling. As already mentioned, once the force F stops, e.g. when the individual get up from the stool, the cushioning portion and the prongs spontaneously assume their second position (i.e. the 'pre-stressed position').

The arrangement is such that the top face of the cushioning portion substantially does not undergo local deformation at the stressed position nor are molding indentations ('sucks') noticed at locations over the top face corresponding with locations of prongs (at the bottom face), owing to thickness, material density, elasticity, etc.

It is noted that a stool is a mere example of a furniture item, and that the cushioning pad subject of the present disclosure can be used in conjunction with any other form of furniture, at any one or more portions thereof, and for any purpose.

It is also appreciated that the resilience and elasticity of the prongs can be selectively governed, by altering various parameters thereof, e.g. length, thickness, density, shape, material properties, etc.

The invention claimed is:

1. A furniture cushioning pad, said cushioning pad being made of molded elastomer material, and comprising a furniture engaging portion and at least a cushioning portion having a top face and a bottom face, with a plurality of resilient prongs projecting from the bottom face; said prongs configurable between a rest, non-deformed position, a pre-stressed position upon articulating the cushioning pad over a rigid surface portion of a furniture element, and a stressed position upon applying pressure over the top face thereof, in which the prongs arbitrarily deform in different orientations, and a thickness of a root of the prongs is equal to or lesser than a thickness of the cushioning portion of the cushioning pad.

2. The furniture cushioning pad of claim 1, wherein the prongs extend substantially parallel to one another.

3. The furniture cushioning pad of claim 1, wherein a longitudinal axis of the prongs extends substantially normal to the bottom face of the cushioning portion.

4. The furniture cushioning pad claim 1, wherein the prongs are equally dispersed over a portion of the bottom face.

5. The furniture cushioning pad of claim 1, wherein the prongs have a uniform cross-section.

6. The furniture cushioning pad of claim 1, wherein the prongs have a tapering cross-section along a longitudinal axis thereof.

7. The furniture cushioning pad of claim 1, wherein the prongs have a staggered cross-section along a longitudinal axis thereof.

8. The furniture cushioning pad of claim 1, wherein the prongs are of substantially similar length.

9. The furniture cushioning pad of claim 1, wherein elasticity of the prongs projecting from the bottom face of the cushioning pad is equal over the entire cushioning portion.

10. The furniture cushioning pad of claim 1, wherein the prongs projecting from the bottom face of the cushioning pad have different elasticity properties, so as to render the cushioning pad with differential cushioning properties.

11. The furniture cushioning pad of claim 1, wherein thickness of the cushioning portion of the cushioning pad is uniform.

12. The furniture cushioning pad of claim 1, wherein the cushioning portion of the cushioning pad is flat.

13. The furniture cushioning pad of claim 1, wherein the cushioning portion of the cushioning pad is slightly domed, to thereby obtain gradually changing stiffness.

14. The furniture cushioning pad of claim 1, wherein the cushioning portion of the cushioning pad is configured with reinforcements for governing stiffness/elasticity parameters thereof.

15. The furniture cushioning pad of claim 1, wherein the cushioning pad is configured with openings, so as to facilitate air discharge upon applying pressure over the top face thereof.

16. The furniture cushioning pad of claim 1, wherein articulation of the furniture engaging portion to a pad mounting portion of a furniture item requires tensioning of at least a portion of the cushioning pad, wherein the furniture engaging portion is configured for elastically tensioning over the pad mounting portion and the furniture engaging portion of the cushioning pad is a skirt portion configured for snug mounting over the pad mounting portion of a furniture item.

17. The furniture cushioning pad of claim 1, wherein the furniture engaging portion of the cushioning pad is configured for circumferential engaging over the pad mounting portion of the furniture item.

18. The furniture cushioning pad of claim 1, wherein at least the top face of the cushioning pad is configured with a natural material mimicking pattern.

19. A furniture item comprising at least a rigid surface portion and a pad mounting portion, wherein a furniture cushioning pad according to claim 1 is applied over said rigid surface portion with a furniture engaging portion secured to the pad mounting portion.

* * * * *